US008500353B2

(12) United States Patent
Kim

(10) Patent No.: US 8,500,353 B2
(45) Date of Patent: Aug. 6, 2013

(54) DRAW-OUT TYPE SOLID MARKER

(75) Inventor: Hak-Jae Kim, Daejeon (KR)

(73) Assignee: Dong-A Teaching Materials Co., Ltd., Daejeon (KR)

( * ) Notice: Subject to any disclaimer, the term of this patent is extended or adjusted under 35 U.S.C. 154(b) by 368 days.

(21) Appl. No.: 13/008,237

(22) Filed: Jan. 18, 2011

(65) Prior Publication Data

US 2011/0182650 A1 Jul. 28, 2011

(30) Foreign Application Priority Data

Jan. 28, 2010 (KR) ..... 20-2010-0001002 U

(51) Int. Cl.
*B43K 23/00* (2006.01)

(52) U.S. Cl.
USPC ..... 401/98; 401/75

(58) Field of Classification Search
USPC ..... 401/68, 72, 75, 78, 86, 98, 202
See application file for complete search history.

(56) References Cited

U.S. PATENT DOCUMENTS 4,770,556 A * 9/1988 Ackermann et al. ..... 401/69
4,966,479 A * 10/1990 Idec et al. ..... 401/68
5,947,624 A * 9/1999 Davignon ..... 401/202
6,331,084 B1 * 12/2001 Ohba ..... 401/68
6,629,797 B1 10/2003 Lee

* cited by examiner

*Primary Examiner* — David Walczak
(74) *Attorney, Agent, or Firm* — Lexyoume IP Meister, PLLC

(57) ABSTRACT

A draw-out solid marker includes a cylindrical shell, a rotary member thread-fastened to the rear end of the shell; a movable member thread-fastened to the rotary member in the shell to move forward/backward from the shell by rotating the rotary member; a cylindrical solid core connected to the front of the movable member to move forward/backward with the movable member and having an elliptical, rectangular, or triangular cross-sectional shape; and a cap coupled to the front end of the shell in order to apply various patterns in accordance with the position of the front end.

3 Claims, 4 Drawing Sheets

DRAW-OUT TYPE SOLID MARKER

CROSS-REFERENCE TO RELATED APPLICATION

This application claims priority to and the benefit of Korean Patent Application No. 20-2010-0001002 filed in the Korean Intellectual Property Office on Jan. 28, 2010, the entire contents of which are incorporated herein by reference.

BACKGROUND OF THE INVENTION (a) Field of the Invention

The present invention relates to a draw-out type solid maker, and more particularly, to a draw-out type solid maker designed for conveniently writing, drawing, and marking etc. by easily drawing out a solid core accommodated in a shell.

(b) Description of the Related Art

Typical solid applicators of which the state is made in a solid state, such as solid wax, are crayon, a pastel crayon, a paste, and a colored pencil etc.

The solid application instruments can perform application on a piece of paper, a white board, glass, a metal member, synthetic resin, and film etc. and has the advantage of having a simple structure and high quality in comparison to ballpoint pens, felt-tip pens, board pens which containing liquid-state ink and write using a ball or a pen line, such they are useful for drawing, painting, coloring, marking, and writing.

The existing solid application instruments are formed in a cylindrical shape or a polygonal cylindrical shape and the outer side is covered with a piece of paper or accommodated in a pipe-shaped case and drawn in/out, which is a draw-out type.

However, the cylindrical or polygonal cylindrical solid application instruments of the related art have a difficulty and discomfort in making various application patterns, such as changing the thickness of lines, when writing, drawing, painting, coloring, and marking.

For example, lines are likely to the drawn with similar thicknesses, regardless of the position of the end on a piece of paper, even though it needs to draw lines with various thicknesses on a piece of paper with the cylindrical solid application instrument.

Therefore, it is required to perform application two times or more to draw a thick line and it is trouble to sharpen the end with a cutter or shave it after applying on others, in order to draw a thin line, such that a solution is required.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a draw-out type solid marker having advantages of being able to change thickness of lines in accordance with the position of the end in applying, by making the solid core to have an elliptical, rectangular, or triangular cross-section, and to easily applying various patterns.

An exemplary embodiment of the present invention provides a draw-out solid marker including: a cylindrical shell; a rotary member thread-fastened to the rear end of the shell; a movable member coupled to the rotary member in the shell to move forward/backward from the shell by rotating the rotary member; a cylindrical solid core connected to the front of the movable member to move forward/backward with the movable member and having an elliptical, rectangular, or triangular cross-sectional shape; and a cap coupled to the front end of the shell.

The core is formed in an elliptical, rectangular, and triangular shape.

The shell has a rotation supporting portion with an inner circumference where the rotary member is rotatably supported and an insertion portion where the solid core is inserted, in front of the rotation supporting portion, and having an inner circumference corresponding to the cross-section of the solid core.

The inner circumference of the insertion portion is formed in one of elliptical, rectangular, and triangular shapes.

The rotary member has a large-diameter portion formed in a cylindrical shape and rotatably supported in the rotary supporting portion of the shell, a small-diameter portion formed in a cylindrical shape having a smaller diameter than the large-diameter portion, integrally extending forward with respect to shell from one end of the large-diameter portion, and having a rotation protrusion, and a cap connector integrally extending from the other end of the large-diameter portion and having an inner circumference corresponding to the inner circumference of the cap.

The movable member has a threaded shaft formed in a bar shape, installed on the axis of the rotary member, and having a thread on the outer circumference engaged with the rotation protrusion, and a cylindrical core support having a cross-section corresponding to the insertion portion of the shell, integrally formed at one end of the threaded shaft, and receiving the end of the solid core.

The cap is formed in a cylindrical shape with one end open, having the inner circumference corresponding to the cross-section of the solid core, and having a clip on the outer circumference.

The outer circumferences of the shell and the cap may correspond to the cross-section of the solid core.

According to the draw-out type solid marker of the present invention, since the solid core is formed to have an advantage in drawing lines with various thicknesses, it is possible to simply draw various patterns with one core, without changing the cores in accordance with the thicknesses of desired lines.

Further, according to the draw-out type solid marker of the present invention, since the solid core can be safely accommodated and can be conveniently drawn out for use by rotating the rotary member, if necessary, it is possible to safely store by reducing possibility of damage or break and conveniently and safely use by drawing out only the front end.

Further, according to the draw-out type solid marker of the present invention, since it is possible to simply draw out the solid core using the assembly of shell, rotary member, and movable member, without a specific part, as compared with when one part, the shell, has the portion accommodating the solid core and the portion rotatably coupled with the rotary member, it is possible to improve assemblage performance and productivity by reducing the number of parts, and reduce the manufacturing cost.

Further, according to the draw-out type solid marker of the present invention, since it is possible to make the outer circumferences of the shell and the cap in various shapes, it is possible to provide a new and refined external appearance, not the cylinder or polygon in the related art.

DETAILED DESCRIPTION OF THE EMBODIMENTS

Draw-out type solid markers according to exemplary embodiments of the present invention are described hereafter in detail with reference to the accompanying drawings.

Figure 1:
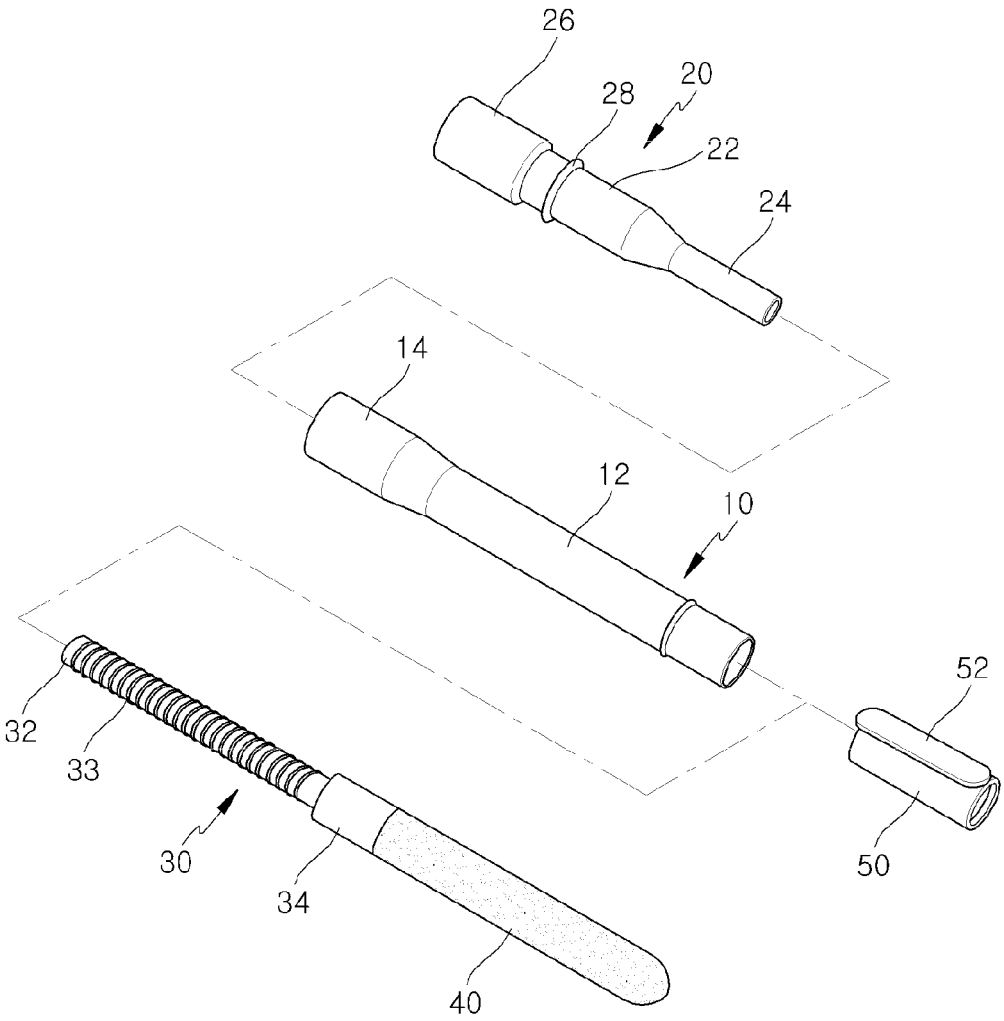
FIG. 1 is an exploded perspective view showing a draw-out type solid marker according to an exemplary embodiment of the present invention.
Figure 2:
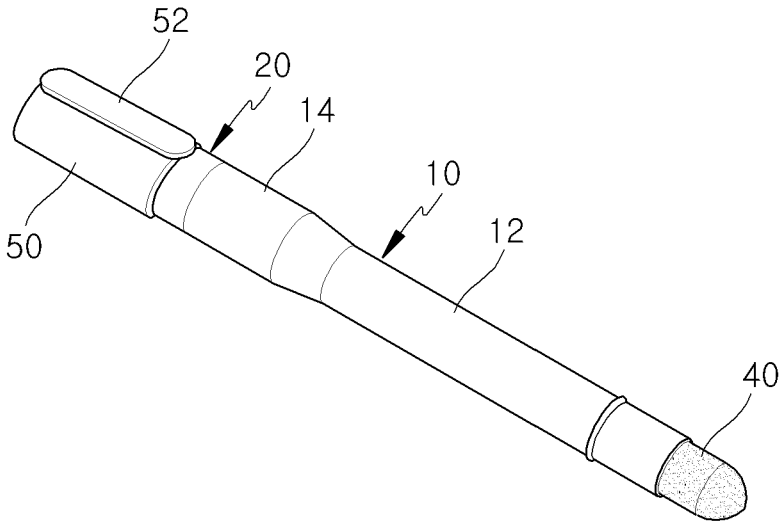
FIG. 2 is an assembly perspective view showing an exemplary embodiment of a draw-out type solid marker according to an exemplary embodiment of the present invention.
Figure 3:
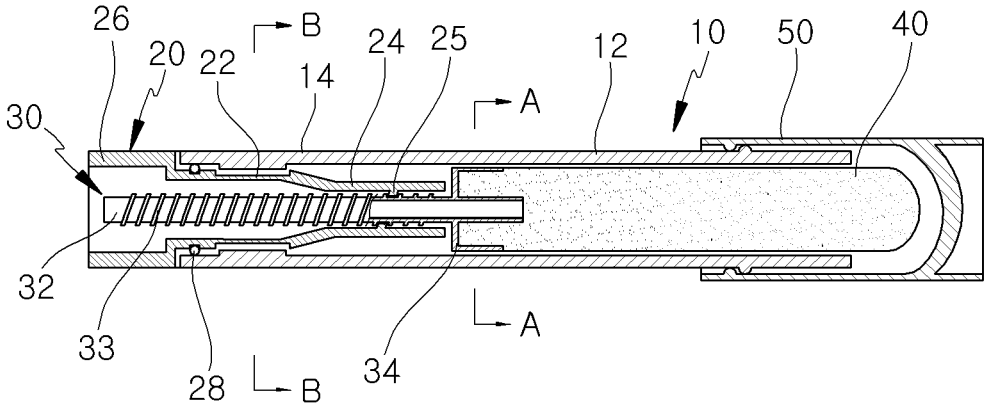
FIG. 3 is an assembly cross-sectional view of a draw-out type solid marker according to an exemplary embodiment of the present invention.
Figure 4:
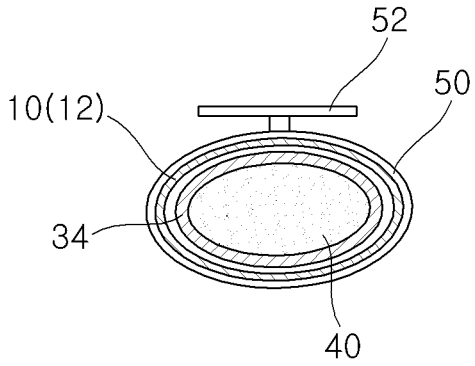
FIG. 4 is a cross-sectional view taken along the line A-A of FIG. 3.
Figure 5:
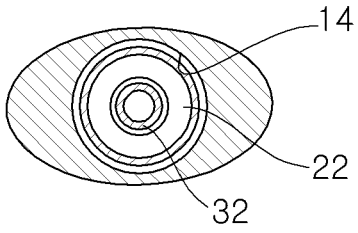
FIG. 5 is a cross-sectional view taken along the line B-B of FIG. 3.

First, as shown in FIG. 1 to 3, a draw-out type solid marker according to an exemplary embodiment of the present invention includes a cylindrical shell 10, a rotary member 20 rotatably coupled to the rear end of the shell 10, a movable member 30 thread-fastened to the rotary member 20 in the shell 10 to moving forward/backward from the shell 10 by rotating the rotary member 20, a core 40 connected to the front end of the movable member 30 in a solid state, and a cap 50 coupled to the front end of the shell 10.

The core 40 is formed in a cylindrical shape having an elliptical cross-section.

Figure 6:
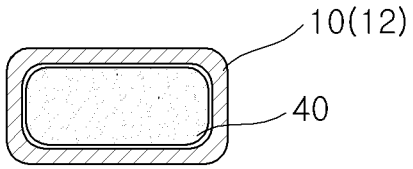
FIG. 6 is a cross-sectional view showing a draw-out type solid marker according to another exemplary embodiment of the present invention.
Figure 7:
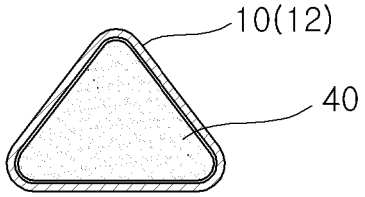
FIG. 7 is a cross-sectional view showing a draw-out type solid marker according to another exemplary embodiment of the present invention.

Although it has been described in the above that the core 40 has an elliptical cross-section, it is not limited thereto and may be formed to have a rectangular cross-section, as shown in FIG. 6, or may be formed to have a triangular cross-section, as shown in FIG. 7.

The shell 10 is substantially formed in a pipe shape.

The shell 10 is divided into a rotation supporting portion 14 with an inner circumference where the rotary member 20 is rotatably supported and an insertion portion 12 where the solid core 40 is inserted, in front of the rotation supporting portion 14, and having an inner circumference corresponding to the cross-section of the solid core 40.

The inner circumference of the insertion portion 12 has one of elliptical, rectangular, and triangular cross-sectional shapes.

The shell 10 may partially or entire has a circumference corresponding to the cross-section of the solid core 40.

The rotary member 20 has a large-diameter portion 22 formed in a cylindrical shape and rotatably supported in the rotary supporting portion 14 of the shell 10, a small-diameter portion 24 formed in a cylindrical shape having a smaller diameter than the large-diameter portion 22, integrally extending forward with respect to the shell 10 from one end of the large-diameter portion 22, and having a rotation protrusion 25, and a cap connector 26 integrally extending from the other end of the large-diameter portion 22 to be coupled with the cap 50.

In this structure, a ring-shape packing 28 may be disposed between the rotation supporting portion 14 of the shell 10 and the large-diameter portion 22 of the rotary member 20.

The packing 28 may be made of a material having excellent lubrication and may be coated with a lubricant on the surface to implement smooth relative rotation between the shell 10 and the rotary member 20.

The movable member 30 has a threaded shaft 32 formed in a bar shape and having a thread 33 engaged with rotary protrusions 25 in the small-diameter portion 24 on the outer circumference and a core support 34 formed in a cylindrical shape integrally at one end of the threaded shaft 32 and receiving one end of the solid core 40.

The core support 34 has a cross-section corresponding to the inner surface of the insertion portion 12. That is, it may have an elliptical, rectangular, or triangular cross-section.

The solid core 40 moves forward/backward with the movable member 30 by the rotation of the rotary member 20.

For example, the solid core 40 moves forward with clockwise rotation of the rotary member 20 and moves backward with counterclockwise rotation of the rotary member 20.

The solid core 40 is inserted in the insertion portion 12 of the shell, entirely or except for the front end when moving backward.

The cap 50 is formed in a cylinder with one side open and has an inner circumference having an elliptical, rectangular, or triangular shape to correspond to the cross-section of the solid core 40.

The cap 50 may be coupled to the cap connector 26 of the rotary member 20.

The outer circumference of the cap connector 26 has a shape (e.g. an ellipse, a rectangle, or a triangle) corresponding to the shape of the inner circumference of the cap 50.

A clip 52 maybe formed on the outer circumference of the cap 50 to be fixed on cloth.

In the draw-out type solid maker according to an exemplary embodiment of the present invention having the configuration described above, the outer circumference of the shell 10 and/or the cap 50 may have an elliptical, rectangular, or triangular outer shape corresponding to the cross-section of the solid core 40, or other various shapes, such as a circle or a polygon.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A draw-out type solid marker, comprising:

a shell;

a rotary member rotatably coupled to a rear end of the shell;

a movable member coupled to the rotary member in the shell and movable forward/backward from the shell according to rotation of the rotary member;

a solid core connected to a front portion of the movable member and movable forward/backward with the movable member, the solid core having an elliptical cross-sectional shape; and a cap removably coupled to a front end of the shell, the cap formed with one open end and having an inner circumference with a elliptical shape corresponding to the elliptical cross-sectional shape of the solid core, and a clip formed on an outer circumference of the cap, wherein the shell comprises:

a rotation supporting portion with an inner circumference where the rotary member is rotatably supported; and an insertion portion where the solid core is inserted, the insertion portion connected to the rotation supporting portion having the rear end to form the shell, and the insertion portion having an inner circumference formed in an elliptical shape corresponding to the elliptical cross-sectional shape of the solid core, wherein the rotary member comprises:

a large-diameter portion rotatably supported in the rotary supporting portion of the shell;

a small-diameter portion having a smaller diameter than the large-diameter portion, the small-diameter portion integrally extending forward with respect to the shell from one end of the large-diameter portion, the small-diameter having a rotation protrusion; and a cap connector integrally extending from the other end of the large-diameter portion and having an outer circumference corresponding to the inner circumference of the cap such that the cap is removably coupled to the outer circumference of the cap connector, wherein the movable member comprises:

a threaded shaft formed in a bar shape, installed on an axis of the rotary member, and having a thread engaged with the rotation protrusion on an outer circumference of the shaft; and a core support having a cross-section corresponding to the insertion portion of the shell, integrally formed at one end of the threaded shaft, and receiving an upper end portion of the solid core, wherein each of an outer circumference of the shell and the outer circumference of the cap has an elliptical shape corresponding to the elliptical cross-sectional shape of the solid core.

2. A draw-out type solid marker, comprising:

a shell;

a rotary member rotatably coupled to a rear end of the shell;

a movable member coupled to the rotary member in the shell and movable forward/backward from the shell according to rotation of the rotary member;

a solid core connected to a front portion of the movable member and movable forward/backward with the movable member, the solid core having a rectangular cross-sectional shape; and a cap removably coupled to a front end of the shell, formed with one open end and having an inner circumference with a rectangular shape corresponding to the rectangular cross-sectional shape of the solid core, and a clip formed on an outer circumference of the cap, wherein the shell comprises:

a rotation supporting portion with an inner circumference where the rotary member is rotatably supported; and an insertion portion where the solid core is inserted, the insertion portion connected to the rotation supporting portion having the rear end to form the shell, and the insertion portion having an inner circumference formed in a rectangular shape corresponding to the rectangular cross-sectional shape of the solid core, wherein the rotary member comprises:

a large-diameter portion rotatably supported in the rotary supporting portion of the shell;

a small-diameter portion having a smaller diameter than the large-diameter portion, the small-diameter portion integrally extending forward with respect to the shell from one end of the large-diameter portion, the small-diameter having a rotation protrusion; and a cap connector integrally extending from the other end of the large-diameter portion and having an outer circumference corresponding to the inner circumference of the cap such that the cap is removably coupled to the outer circumference of the cap connector, wherein the movable member comprises:

a threaded shaft formed in a bar shape, installed on an axis of the rotary member, and having a thread engaged with the rotation protrusion on an outer circumference of the shaft; and a core support having a cross-section corresponding to the insertion portion of the shell, integrally formed at one end of the threaded shaft, and receiving an upper end portion of the solid core, wherein each of an outer circumference of the shell and the outer circumference of the cap has a rectangular shape corresponding to the rectangular cross-sectional shape of the solid core.

3. A draw-out type solid marker, comprising:

a shell;

a rotary member rotatably coupled to a rear end of the shell;

a movable member coupled to the rotary member in the shell and movable forward/backward from the shell according to rotation of the rotary member;

a cylindrical solid core connected to a front portion of the movable member and movable forward/backward with the movable member, the solid core having an triangular cross-sectional shape; and a cap removably coupled to a front end of the shell, the cap formed with one open end and having an inner circumference with a triangular shape corresponding to the triangular cross-sectional shape of the solid core, and a clip formed on an outer circumference of the cap, wherein the shell comprises:

a rotation supporting portion with an inner circumference where the rotary member is rotatably supported; and an insertion portion where the solid core is inserted, the insertion portion connected to the rotation supporting portion having the rear end to form the shell, and the insertion portion having an inner circumference formed in a triangular shape corresponding to the triangular cross-sectional shape of the solid core, wherein the rotary member comprises:

a large-diameter portion rotatably supported in the rotary supporting portion of the shell;

a small-diameter portion having a smaller diameter than the large-diameter portion, the small-diameter portion integrally extending forward with respect to the shell from one end of the large-diameter portion, the small-diameter having a rotation protrusion; and a cap connector integrally extending from the other end of the large-diameter portion and having an outer circumference corresponding to the inner circumference of the cap such that the cap is removably coupled to the outer circumference of the cap connector, wherein the movable member comprises:

a threaded shaft formed in a bar shape, installed on an axis of the rotary member, and having a thread engaged with the rotation protrusion on an outer circumference of the shaft; and a core support having a cross-section corresponding to the insertion portion of the shell, integrally formed at one end of the threaded shaft, and receiving an upper end portion of the solid core, wherein each of an outer circumference of the shell and the outer circumference of the cap has a triangular shape correspond to the triangular cross-sectional shape of the solid core.

* * * * *